United States Patent [19]

Kelley

[11] Patent Number: 4,905,610

[45] Date of Patent: Mar. 6, 1990

[54] ROTABLE DRAFTING TABLE HAVING RECTANGULAR CONFIGURED DRAFTING SURFACE

[76] Inventor: Daniel Kelley, 159 Chichester Rd., Huntington, N.Y. 11743

[21] Appl. No.: 209,293

[22] Filed: Jun. 20, 1988

Related U.S. Application Data

[63] Continuation of Ser. No. 91,843, Sep. 1, 1987, Pat. No. 4,779,543.

[51] Int. Cl.[4] ..... A47B 11/00

[52] U.S. Cl. ..... 108/103; 108/139; 33/435

[58] Field of Search ..... 108/139, 140, 141, 142, 108/27, 90; 408/11; 33/435, 436, 437, 537; 312/140.4

[56] References Cited

U.S. PATENT DOCUMENTS

| | | | |
|---|---|---|---|
| 389,472 | 9/1888 | Hopkins | 33/435 |
| 397,147 | 2/1889 | Sperry | 33/435 |
| 575,842 | 1/1897 | Laughlin et al. | 33/435 |
| 836,919 | 11/1906 | Burbank et al. | 33/435 |
| 1,127,139 | 2/1915 | West | 108/27 X |
| 1,164,253 | 12/1915 | Borntraeger | 33/435 |
| 2,713,723 | 7/1955 | Anderson | 33/435 |
| 2,728,957 | 1/1956 | Keller | 312/140.4 X |
| 3,345,751 | 10/1967 | Barzee et al. | 33/435 |
| 4,779,543 | 10/1988 | Kelley | 108/139 |

*Primary Examiner*—Kenneth J. Dorner
*Assistant Examiner*—José V. Chen
*Attorney, Agent, or Firm*—Burgess, Ryan & Wayne

[57] ABSTRACT

A rotatable drafting table includes a flat base board; a top drafting board position on top of the flat base board, the drafting board having a substantially rectangular configuration with slightly rounded corners; a swivel arrangement secured to the base board and drafting board for rotatably securing the drafting board on the base board; the base board having slide extensions at two front corners thereof; four pins provided at the free ends of the slide extensions and the opposite two corners of the base boards; a wire secured around the four pins; a parallel slide slideably mounted on the wire and positioned above the drafting board; and a braking assembly including at least one rubber brake pad secured at an underside of the drafting board for movement into braking contact with the upper surface of the base board.

4 Claims, 5 Drawing Sheets

ROTABLE DRAFTING TABLE HAVING RECTANGULAR CONFIGURED DRAFTING SURFACE

This is a continuation of application Ser. No. 091,843, filed Sept. 1, 1987, now U.S. Pat. No. 4,779,543.

BACKGROUND OF THE INVENTION

This invention relates generally to drafting tables and, more particularly, is directed to a rotatable drafting table.

Conventionally, draftsman use stationary drafting tables to construct drawings. These tables are usually adjustable in height and can be swivelled to vary the angle or pitch of the table. In addition, it is known to provide parallel slides above the drafting surface of such tables. Generally, such parallel slides ride along a wire secured around the drafting table so as to move up and down therewith for aiding the draftsman in drawing straight and parallel lines.

However, one disadvantage associated with such conventional drafting tables is that the paper on which the drawing is made is constantly being shifted on the drafting table by the draftsman. Thus, the paper may initially be secured to the drafting table by pins and the like to prevent movement of the paper when drawing thereon. However, to move such paper, the pins must be removed, the paper moved to a different location on the drafting table and then the pins reinserted. This is cumbersome and time consuming.

Accordingly, rotatable drafting tables have been proposed, for example, as disclosed in U.S. Pat. Nos. 2,713,723 and 3,345,751. In both of these tables, a circular drafting board is rotatably mounted in a base board such that the upper surfaces of the drafting board and base board are coplanar with each other. Further, a parallel slide is mounted to the base board above the circular drawing board for slideable movement thereacross.

A problem with such drafting tables, however, is that the drafting area is reduced. Specifically, because the drafting board is formed in a circular configuration, the effective drafting area, as opposed to a conventional rectangular drafting board, is small. If the circle is increased in size, then the base board which rotatably supports the circular drafting board, must consequently be increased in size, which results in additional space being occupied.

Further, with a circular drafting board, the paper must generally be situated near the center of the circle to obtain maximum usage thereof. This results in the paper being positioned further away from the draftsman than with a conventional rectangular drafting board where the paper can be positioned at the edge of the drafting board. As a result, the draftsman must reach out further, making it more difficult for the draftsman to draw on the paper. See also U.S. Pat. Nos. 324,855; 915,418; 1,395,200; 3,261,099; and 4,450,774 for similar disclosures. As to U.S. Pat. No. 1,395,200, there is disclosed therein a brake spring 20 and screw 19 for locking the rotatable drafting board in position. U.S. Pat. No. 2,610,099 discloses a rotating and reciprocating table top. However, this table top is not used as a drafting table, but rather, is used as a support for a television receiver. Thus, the problem of constructing a parallel slide with a rectangular drafting board is not disclosed or suggested by this patent.

OBJECTS AND SUMMARY OF THE INVENTION

Accordingly, it is an object of the present invention to provide a rotatable drafting table that overcomes the aforementioned difficulties encountered in the prior art.

More particularly, it is an object of the present invention to provide a rotatable drafting table that has a rectangular drafting board.

It is another object of the present invention to provide a rotatable drafting table having a rotatable drafting board and a parallel slide movable thereabove.

It is still another object of the present invention to provide a rotatable drafting table having a rectangular drafting board and a parallel slide that can be positioned at the edges of the drafting table, regardless of the orientation of the drafting board.

In accordance with an aspect of the present invention, a rotatable drafting table includes a flat base board, a top drafting position on top of the flat base board, a drafting board having a substantially rectangular configuration with slightly rounded corners and an upper surface; rotation means for rotatably securing the base board and the drafting board; a parallel slide; and mounting means secured to the base board for slidably mounting the parallel slide at a position above the upper surface of the drafting board so as to permit the rotation of the latter on the base board.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
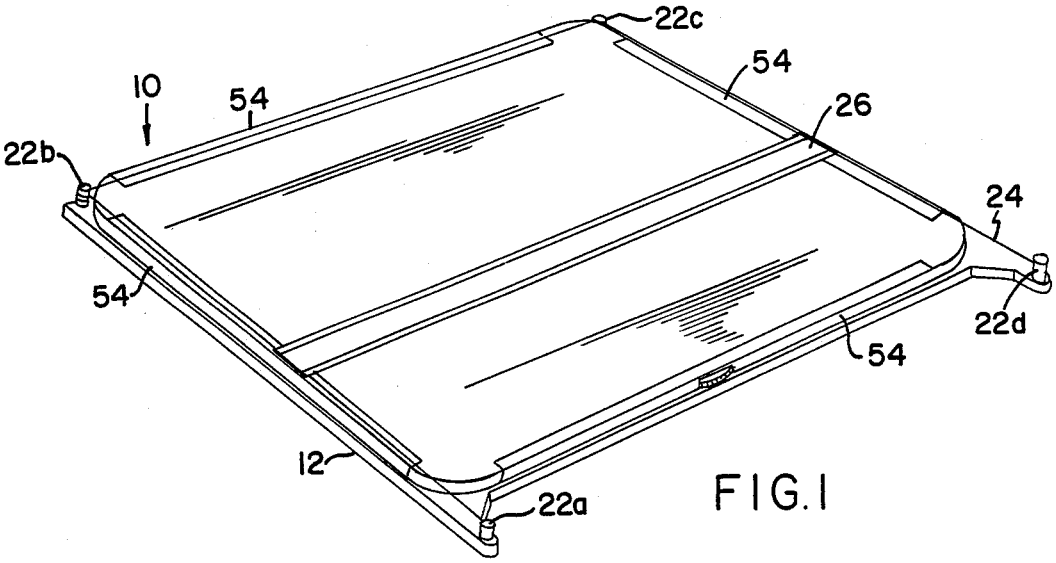
FIG. 1 is a perspective view of the drafting table according to the present invention in assembled condition.
Figure 2:
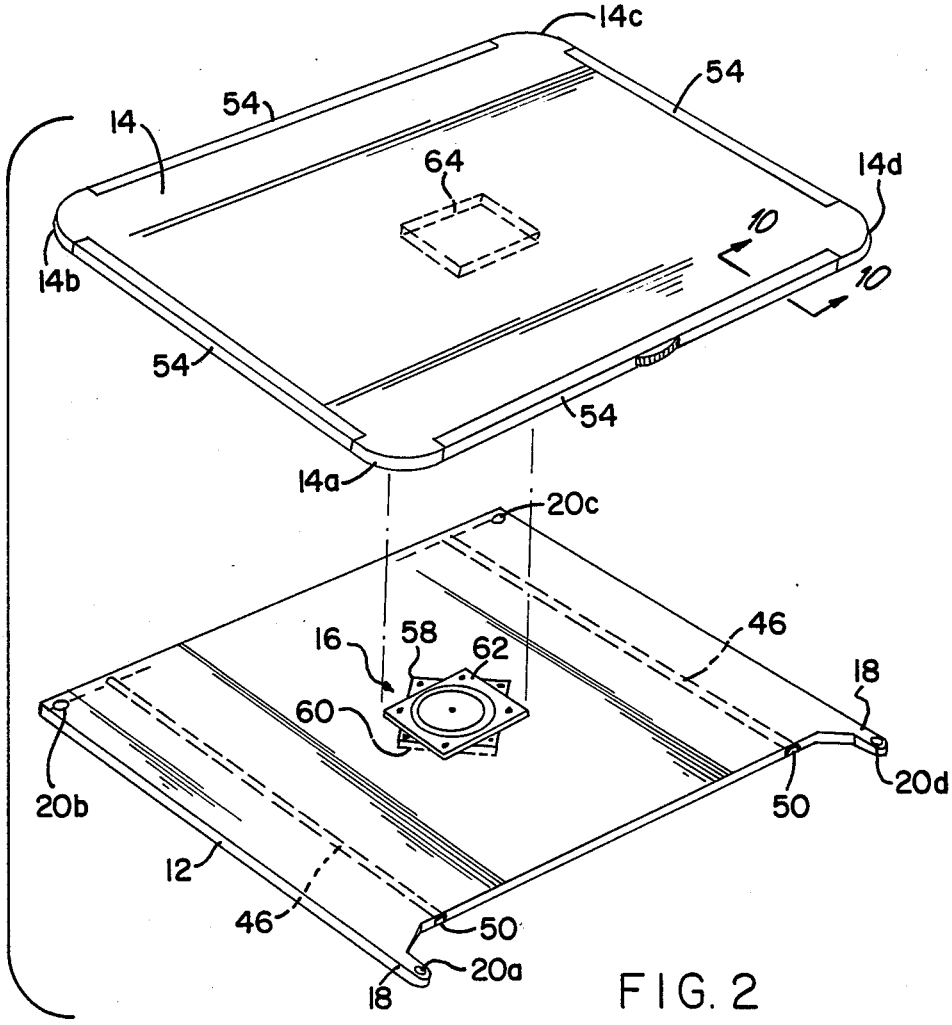
FIG. 2 is a blown-apart perspective view of the drafting board of FIG. 1.
Figure 3:
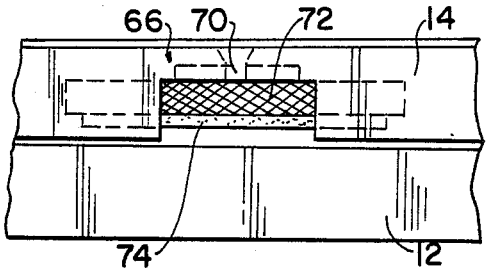
FIG. 3 is an elevational view of a portion of the drafting board of FIG. 1 showing the mechanism for tightening the drafting board to the base board.
Figure 4:
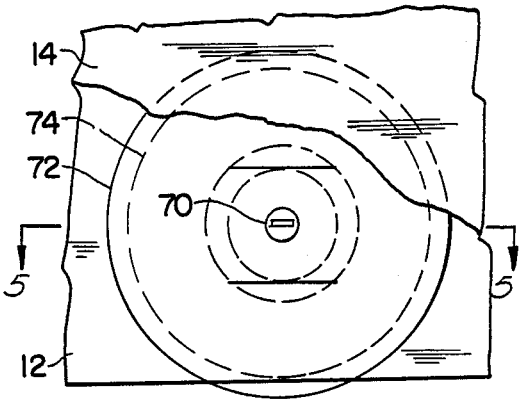
FIG. 4 is a top plan view of a portion of the drafting table of FIG. 1, partially in phantom, showing the tightening mechanism of FIG. 3.
Figure 5:
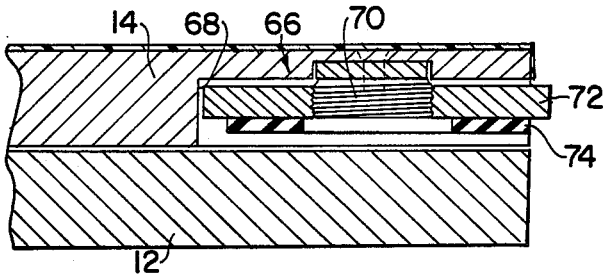
FIG. 5 is a cross-sectional view of the portion of the drafting table shown in FIG. 4, taken along line 5—5 thereof.
Figure 6:
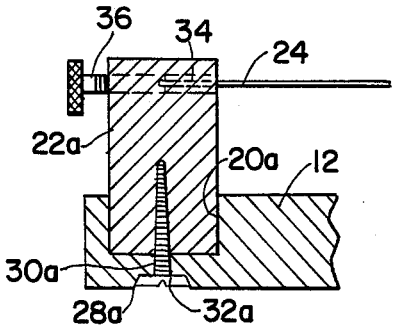
FIG. 6 is a cross-sectional view of a portion of a first wire peg for mounting the wire used for supporting the parallel slide.
Figure 7:
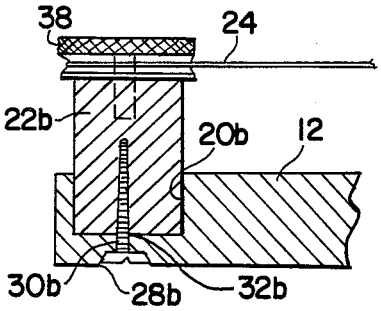
FIG. 7 is a cross-sectional view of a second wire peg used for mounting the wire used for supporting the parallel slide.
Figure 8:
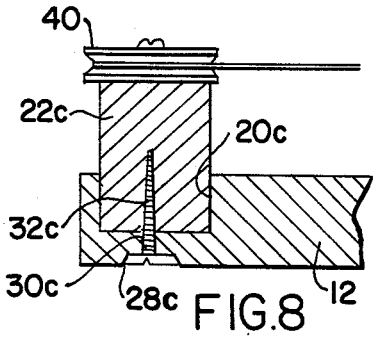
FIG. 8 is a cross-sectional view of a third mounting peg for mounting the wire used for supporting the parallel slide.
Figure 9:
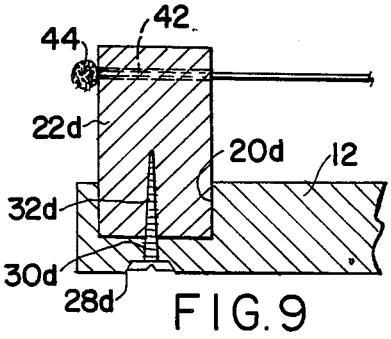
FIG. 9 is a cross-sectional view of a fourth mounting peg for mounting the wire used for supporting the parallel slide.

Referring to the drawings in detail, and initially to FIGS. 1 and 2 thereof, a drafting table 10 according to the present invention, includes a flat, substantially rectangular base board 12; a top, substantially rectangular drafting board 14 positioned on top of base board 12, and rotation means 16 for rotatably securing drafting board 14 on base board 12. Specifically, base board 12 has a substantially rectangular configuration with parallel slide extensions 18 extending from opposite front corners thereof. The free ends of slide extensions 18 and the opposite corners of base board 12 are also formed with circular recesses 20*a*–20*d*, which are better shown in FIGS. 6–9. Recesses 20*a*–20*d* are provided for mounting wire supporting pegs 22*a*–22*d* respectively therein, which are used to support and guide a wire 24 which, in turn, supports a parallel slide 26, as will be described in greater detail hereinafter. The underside of base board 12 is formed with four smaller recesses 28*a*–28*d* which are co-axial with recesses 20*a*–22*a* respectively and are interconnected therewith by small passages 30*a*–30*d*, respectively. In this matter, a screw 32*a*–32*d* can be countersunk within recesses 28*a*–28*d* and passages 30*a*–30*d* and are screw-threadedly received within the bottom of the respective pegs 22*a*–22*d* for securing the latter in recesses 20*a*–20*d*.

The upper end of peg 22*a* is formed with a passage 34 therein through which one end of the wire 24 extends and is secured to the end of a bolt 36 screw-threadedly received in passage 34. From there, wire 24 extends around a wire lock 38 screw-threadedly received at the upper end of peg 22*b*. When wire lock 38 is screwed down, it clamps wire 24 thereto in a conventional manner. Wire 24 travels from peg 22*b* to a stationary wire guide 40 secured to the upper end of peg 22*c* and from there extends through a passage 42 at the upper end of peg 22*d* and is then tied in a knot or bundle 44 to prevent escape therefrom. In this manner, adjustment of wire 24 can be made by wire tension adjustment screw 36 and wire lock 38. Thus, wire 24 extends around pegs 22*a*–22*d* at a height above the upper surface of drafting board 14 when the latter is rotatably secured on base board 12.

As shown in FIG. 1, parallel slide 26 is slideably received on wire 24 in a conventional manner and need not be described further herein.

Figure 11:
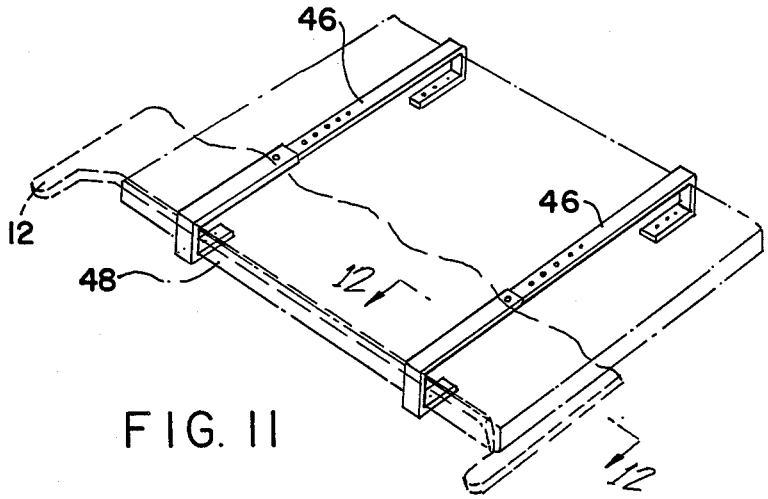
FIG. 11 is a perspective view showing the underside of the base board and means for mounting the base board on an existing table.
Figure 12:
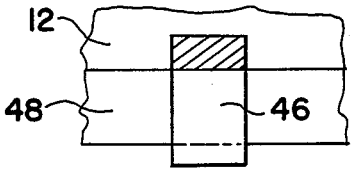
FIG. 12 is a cross-sectional view of the base board mounted on an existing table with the brackets of FIG. 11 taken along line 12—12 of FIG. 11.

The underside of base board 12, as shown in FIGS. 2 and 11 and brackets 46 secured on an existing table 48 can be used for securing base board 12 onto such existing table 48 to thereby secure drafting table 10 onto such an existing table. In this regard, the underside of base board 12 can be formed with longitudinal recesses 50 for guiding brackets 46 therein.

Drafting board 14, in accordance with the present invention, is formed in a substantially rectangular configuration having rounded corners 14*a*–14*d*. As will be appreciated from the discussion which follows, and particularly with respect to the operation which will be described with respective FIGS. 13–15, rounded corners 14*a*–14*d* need only be slightly rounded in order to permit drafting board 14 to rotate on base board 12 without hitting pegs 22*a*–22*d*.

Figure 10:
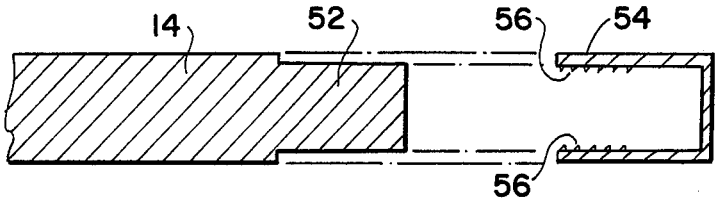
FIG. 10 is a cross-sectional view of an end of the drafting board of FIG. 2, taken along line 10—10 thereof.

As shown in FIGS. 1, 2 and 10, drafting board 14 has its straight edges cut away to form narrow edge sections 52. U-shaped metal edge guards 54 having knurled interfaces 56 are force fit over narrow edge sections 52 such that the upper and lower surfaces thereof are coplanar with the upper and lower surface of drafting board 14. This provides protection for the drafting board 14 and also provides an accurate straight edge against which a T-square or the like can be positioned for drawing straight lines on the drafting board.

Figure 13:
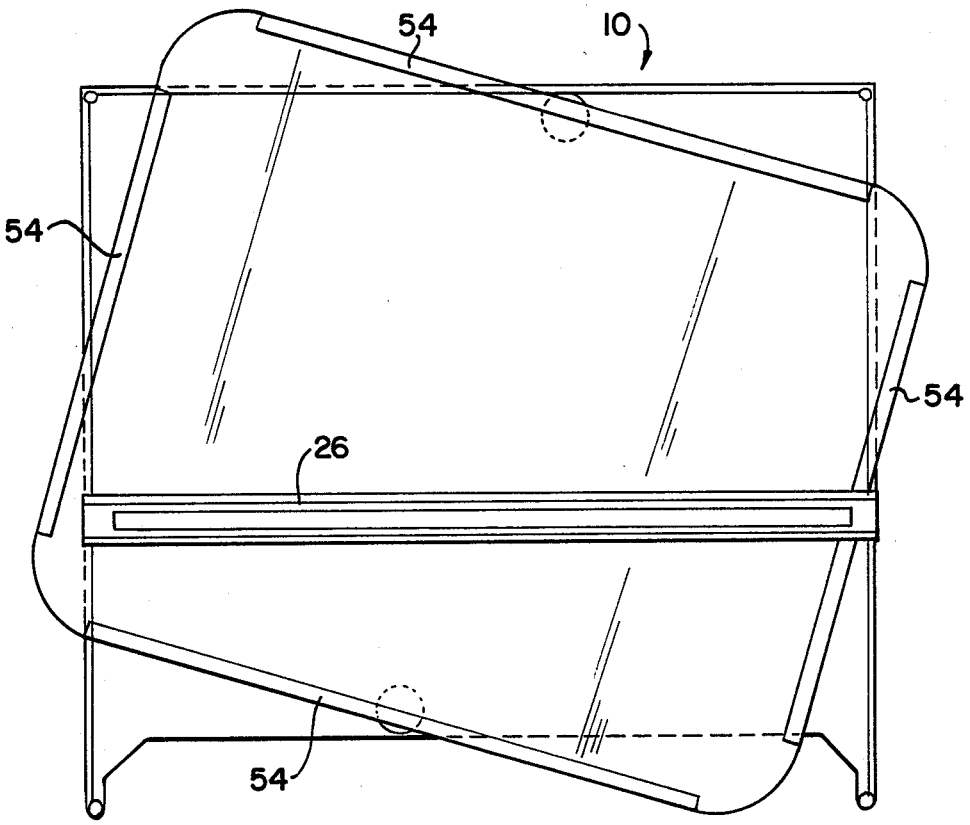
FIG. 13 is a top plan view of the drafting table of FIG. 1, with the drafting board slightly rotated with respect to the base board.
Figure 15:
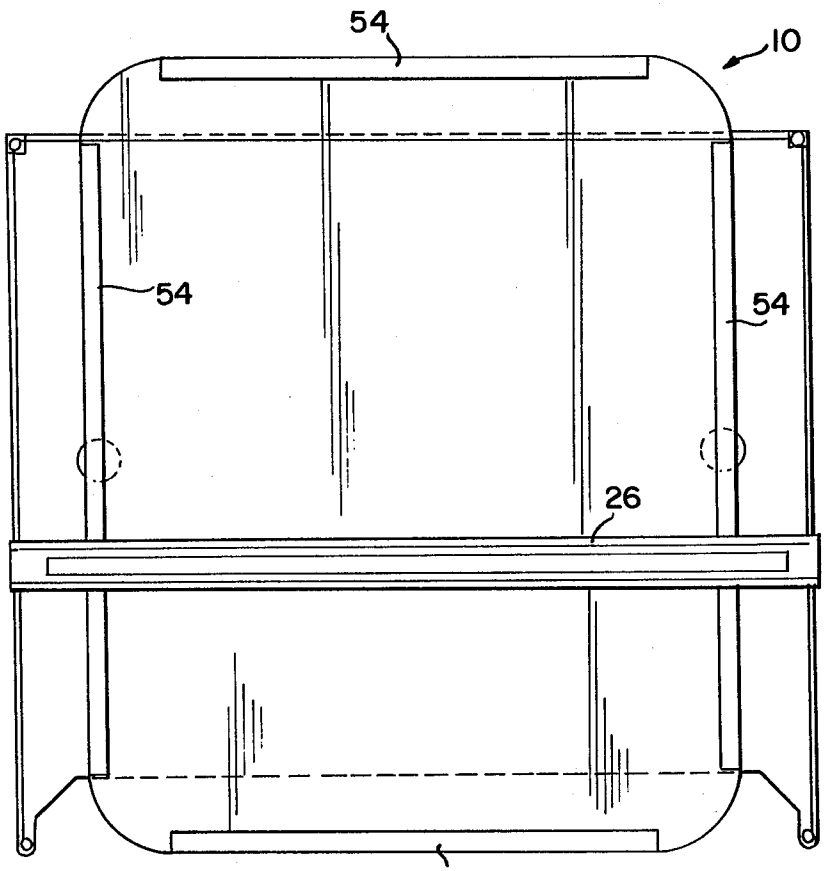
FIG. 15 is a top plan view of the drafting table of FIG. 1, with the drafting board rotated 90 degrees with respect to the base board.
Figure 14:
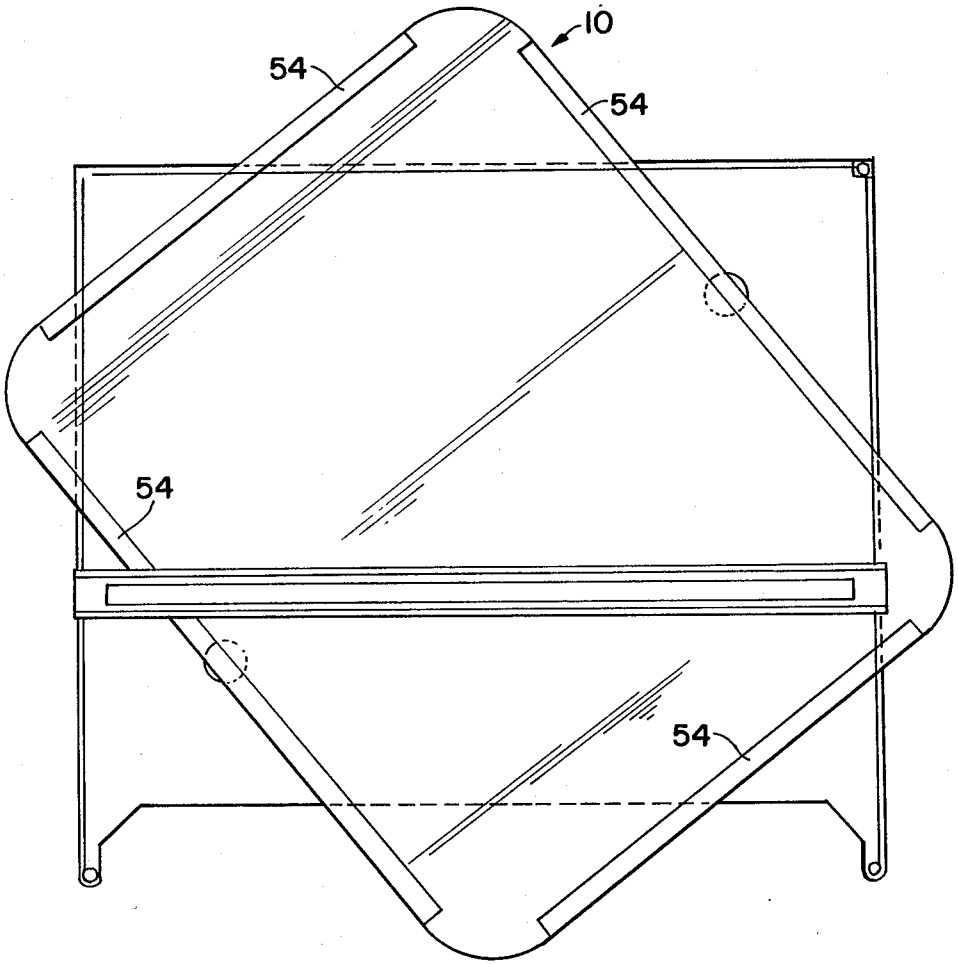
FIG. 14 is a top plan view of the drafting table of FIG. 1, with the drafting board rotated approximately 90 degrees with respect base board.

In order to rotatably secure drafting board 14 onto base board 12, the aforementioned rotation means 16 is provided. Specifically, rotation means 16 is a conventional swivel arrangement commonly used for bar stools, boat chairs and the like. Specifically, rotation means 16 includes a first square plate 58 which is secured in a square recess 60 in the upper surface of base board 12. In like manner, a second square plate 62 is fixedly secured in a recess 64 in the underside of drafting board 14. Square plates 58 and 62 are rotatably secured to each other in a conventional manner such that drafting board 14 is rotatably secured to base board 12 at a central position of drafting board 14. It will be appreciated that, since the outer edges of drafting board 14 are not supported, edge guards 54 also provide additional stability of the outer edges of drafting board 14. Because of the rounded edges 14*a*–14*d*, when drafting board 14 is rotated with respect to base board 12, as shown in FIGS. 13–15, drafting board 14 does not hit pegs 22*a*–22*d*. Further, wire 24 and parallel slide 26 are positioned at heights above the upper surface of drafting board 14 so as not to prevent rotation thereof. It will further be appreciated that slide extensions 18 are provided in order to permit slide 26 to slide to the edge of drafting board 14 when the latter is rotated to the positions shown in FIG. 15.

In order to lock drafting board 14 at a fixed rotational position with respect to base board 12, locking means 66 are provided at each of the four edges of drafting board 14. Specifically, the underside of drafting board 14 is provided with a recess 68 centrally of each of the four edges thereof. A screw-threaded shaft 70 is secured within each recess 68 and a knurled edge disc 72 is screw-threadedly received on shaft 70, with a portion of each knurled edged disc 72 extending outwardly from drafting board 14. A rubber brake pad 74 is secured to the underside of each knurled edge disc 72. Thus, as each knurled disc 72 is rotated downwardly, it forces the respective brake pad 74 into contact with the upper surface of base board 12 and tightens the same thereon to prevent movement of drafting board 14 with respect to base board 12. Generally, opposing knurled edge discs 72 are threaded with left and right screw thread, respectively, so that they can be turned simultaneously by the draftsman in the same direction for tightening opposing brake pads 74.

Thus, the present invention provides a rotatable drafting table which eliminates the time consuming task of removing and repositioning the paper thereon. Further, a full rectangular surface can be provided for drafting along with a parallel slide. Thus, the present invention can be used with standard size sheets of paper. In this regard, it is preferable that the drafting table have a length which is not greater that 1.2 times the width. A preferred measurement of drafting board 14 is therefore 5 feet by 4 feet in order to permit adequate swiveling. In this regard, the drafting table, according to the present invention, can be used with standard size sheets of paper such as 24 inches by 36 inches all the way up to 36 inches by 72 inches.

Having described a specific preferred embodiment of the invention with reference to the accompanying drawings, it will be appreciated that the present invention is not limited to that precise embodiment and that various changes and modifications can be effected therein by one of ordinary skill in the art without departing from the spirit or scope of the invention as defined in the appendive claims.

What is claimed is:

1. A rotatable drafting table comprising:

a flat base board;

a top drafting board positioned on top of said flat base board, said drafting board having a substantially rectangular configuration with slightly rounded corners and an upper surface;

rotation means for rotatably securing said base board and said drafting board;

braking means for locking said drafting board at a desired angular position with respect to said base board, said brake means including at least one recess formed in an underside of said drafting board near an edge thereof, a screw-threaded shaft mounted in each said recess, a disc screw-threadedly received on each said shaft and extending at least partially past the edge of the drafting board and a rubber pad secured to an underside of said disc for movement into braking contact with an upper surface of said base board upon rotation of said disc to lock said drafting board to said base board at a desired angle;

a parallel slide; and mounting means secured to said base board for slidably mounting said parallel slide at a position above said upper surface of said drafting board so as to permit rotation of the latter on said base board.

2. A rotatable drafting table comprising:

(a) a flat base board;

(b) a top drafting board positioned on top of said flat base board, said drafting board having a substantially rectangular configuration with slightly rounded corners and an upper surface, said drafting board having a length and a width and said length does not exceed 1.2 times said width;

(c) said base board having dimensions substantially equal to the dimensions of said drafting board and including two parallel slide extensions at a front edge of the baseboard at two front corners thereof;

(d) rotation means for rotatably securing said base board and said drafting board;

(e) a parallel slide;

(f) brake means for locking said drafting board at a desired angular position with respect to said base board, said brake means including:

(i) at least one recess formed in one of said:

(A) drafting board or (B) said base board (ii) a screw-threaded shaft extending in each said recess, (iii) an actuating knob mounted with said screw-threaded shaft being exposed for actuation and (iv) a rubber pad positioned in said recess for movement into braking contact with one of a lower surface of said drafting board or an upper surface of said base board upon rotation of said actuating knob to lock said drafting board to said base board at a desired angle;

(g) mounting means secured to said base board for slidably mounting said parallel slide at a position above said upper surface of said drafting board so as to permit rotation of the drafting board on said base board, said mounting means including:

(i) a wire positioned above the upper surface of said drafting board for slidably securing said parallel slide thereon, and (ii) four peg means secured to said base board for holding said wire above the upper surface of said drafting board, the distance between to upper ones of said peg means being substantially equal to the length of the drafting board and two lower ones of said peg means being mounted on said slide extensions, whereby said parallel slide can be moved to a lower edge of said drafting board, regardless of the angular orientation of said drafting board on said base board.

3. A drafting table according to claim 2 wherein said base board has an upper surface with a central recess therein;

said drafting board has a lower surface with a central recess therein; and said rotation means includes a first plate secured within said central recess of said base board and a second plate secured within said central recess of said drafting board and means for rotatably securing said first and second plates together.

4. A rotatable drafting table according to claim 2 wherein said drafting board has a substantially constant thickness and four substantially linear edges, at least one of said edges being routed so as to have a thickness that is smaller than said constant thickness; and said drafting board further includes at least one edge guide which fits over such routed edge to provide added strength at said edges and a straight surface for drafting.

* * * * *